US009308739B2

(12) United States Patent
Maruyama

(10) Patent No.: US 9,308,739 B2
(45) Date of Patent: Apr. 12, 2016

(54) PRINT CONTROL DEVICE, CONTROL METHOD OF A POSITIONING DATA, AND POSITIONING SYSTEM

(71) Applicant: Seiko Epson Corporation, Tokyo (JP)

(72) Inventor: Naoki Maruyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/159,497

(22) Filed: Jan. 21, 2014

(65) Prior Publication Data

US 2014/0210892 A1 Jul. 31, 2014

(30) Foreign Application Priority Data

Jan. 30, 2013 (JP) ..... 2013-015203
Mar. 15, 2013 (JP) ..... 2013-053230

(51) Int. Cl.
*B41J 29/38* (2006.01)
*B41J 2/21* (2006.01)

(52) U.S. Cl.
CPC ..... *B41J 2/21* (2013.01)

(58) Field of Classification Search
None
See application file for complete search history.

(56) References Cited

U.S. PATENT DOCUMENTS

2006/0197998 A1* 9/2006 Shibuya et al. ..... 358/518
2009/0128838 A1* 5/2009 Yamamoto ..... G06K 15/02 358/1.9
2012/0147394 A1* 6/2012 Matsuzaki ..... 358/1.9
2012/0194871 A1 8/2012 Murata

FOREIGN PATENT DOCUMENTS

JP 2002199236 A * 7/2002
JP 2006-279922 10/2006
JP 2009-141941 6/2009
JP 2012-158059 8/2012
JP 2012-158060 8/2012

* cited by examiner

*Primary Examiner* — Bradley Thies

(57) ABSTRACT

When the discharge volume of a specific ink is adjusted additionally to uniformly adjusting the discharge volume of a plurality of inks used for printing, a correction ratio input unit of a printer driver execution unit of a print control device receives input of a total correction ratio for correcting the discharge volume of cyan ink, magenta ink, yellow ink, and black ink, and receives input of a specific correction ratio for further correcting the discharge volume of black ink. The discharge volume correction unit sets the corrected discharge volume of cyan ink, magenta ink, and yellow ink to the product of the rated discharge volume times the total correction ratio, and sets the corrected discharge volume of black ink to the product of the rated discharge volume times a correction ratio multiple, which is the product of the total correction ratio and the specific correction ratio.

9 Claims, 8 Drawing Sheets

THIRD SLIDER -1 SETTING (Bkfr=95%)
FOURTH SLIDER 0 SETTING (Allfr=100%)

| | RATED DISCHARGE VOLUME | ACTUAL DISCHARGE VOLUME | EQUATION |
|---|---|---|---|
| BLACK | 25 | 23.8 | Bkvq=(Bkrq=25) x (Bkfr=95%) EQUATION (1) |
| CYAN | 25 | 25.4 | CMYvq=(CMYrq=25) + ((Bkrq=25) - Bkvq(23.8))/3 EQUATION (2) |
| MAGENTA | 25 | 25.4 | CMYvq=(CMYrq=25) + ((Bkrq=25) - Bkvq(23.8))/3 EQUATION (2) |
| YELLOW | 25 | 25.4 | CMYvq=(CMYrq=25) + ((Bkrq=25) - Bkvq(23.8))/3 EQUATION (2) |
| TOTAL INK DISCHARGE VOLUME | 100 | 100 | |

| SETTING | | CORRECTION RATIO | | | |
|---|---|---|---|---|---|
| FIRST SLIDER | SECOND SLIDER | CYAN (%) | MAGENTA (%) | YELLOW (%) | BLACK (%) |
| −6 | −6 | 70 | 70 | 70 | 49 |
| | −5 | 70 | 70 | 70 | 53 |
| | −4 | 70 | 70 | 70 | 56 |
| | −3 | 70 | 70 | 70 | 60 |
| | −2 | 70 | 70 | 70 | 63 |
| | −1 | 70 | 70 | 70 | 67 |
| | 0 | 70 | 70 | 70 | 70 |
| −5 | −6 | 75 | 75 | 75 | 53 |
| | −5 | 75 | 75 | 75 | 56 |
| | −4 | 75 | 75 | 75 | 60 |
| | −3 | 75 | 75 | 75 | 64 |
| | −2 | 75 | 75 | 75 | 68 |
| | −1 | 75 | 75 | 75 | 71 |
| | 0 | 75 | 75 | 75 | 75 |
| −4 | −6 | 80 | 80 | 80 | 56 |
| | −5 | 80 | 80 | 80 | 60 |
| | −4 | 80 | 80 | 80 | 64 |
| | −3 | 80 | 80 | 80 | 68 |
| | −2 | 80 | 80 | 80 | 72 |
| | −1 | 80 | 80 | 80 | 76 |
| | 0 | 80 | 80 | 80 | 80 |
| −3 | −6 | 85 | 85 | 85 | 60 |
| | −5 | 85 | 85 | 85 | 64 |
| | −4 | 85 | 85 | 85 | 68 |
| | −3 | 85 | 85 | 85 | 72 |
| | −2 | 85 | 85 | 85 | 77 |
| | −1 | 85 | 85 | 85 | 81 |
| | 0 | 85 | 85 | 85 | 85 |
| −2 | −6 | 90 | 90 | 90 | 63 |
| | −5 | 90 | 90 | 90 | 68 |
| | −4 | 90 | 90 | 90 | 72 |
| | −3 | 90 | 90 | 90 | 77 |
| | −2 | 90 | 90 | 90 | 81 |
| | −1 | 90 | 90 | 90 | 86 |
| | 0 | 90 | 90 | 90 | 90 |
| −1 | −6 | 95 | 95 | 95 | 67 |
| | −5 | 95 | 95 | 95 | 71 |
| | −4 | 95 | 95 | 95 | 76 |
| | −3 | 95 | 95 | 95 | 81 |
| | −2 | 95 | 95 | 95 | 86 |
| | −1 | 95 | 95 | 95 | 90 |
| | 0 | 95 | 95 | 95 | 95 |
| 0 | −6 | 100 | 100 | 100 | 70 |
| | −5 | 100 | 100 | 100 | 75 |
| | −4 | 100 | 100 | 100 | 80 |
| | −3 | 100 | 100 | 100 | 85 |
| | −2 | 100 | 100 | 100 | 90 |
| | −1 | 100 | 100 | 100 | 95 |
| | 0 | 100 | 100 | 100 | 100 |

FIG. 3

FIG. 7A

THIRD SLIDER 0 SETTING (Bkfr=100%)
FOURTH SLIDER 0 SETTING (Allfr=100%)

| | RATED DISCHARGE VOLUME | ACTUAL DISCHARGE VOLUME |
|---|---|---|
| BLACK | 25 | 25 |
| CYAN | 25 | 25 |
| MAGENTA | 25 | 25 |
| YELLOW | 25 | 25 |
| TOTAL INK DISCHARGE VOLUME | 100 | 100 |

FIG. 7B

THIRD SLIDER -1 SETTING (Bkfr=95%)
FOURTH SLIDER 0 SETTING (Allfr=100%)

| | RATED DISCHARGE VOLUME | ACTUAL DISCHARGE VOLUME | EQUATION |
|---|---|---|---|
| BLACK | 25 | 23.8 | Bkvq=(Bkrq=25) x (Bkfr=95%) EQUATION (1) |
| CYAN | 25 | 25.4 | CMYvq=(CMYrq=25) + ((Bkrq=25) - Bkvq(23.8))/3 EQUATION (2) |
| MAGENTA | 25 | 25.4 | CMYvq=(CMYrq=25) + ((Bkrq=25) - Bkvq(23.8))/3 EQUATION (2) |
| YELLOW | 25 | 25.4 | CMYvq=(CMYrq=25) + ((Bkrq=25) - Bkvq(23.8))/3 EQUATION (2) |
| TOTAL INK DISCHARGE VOLUME | 100 | 100 | |

FIG. 7C

THIRD SLIDER -1 SETTING (Bkfr=95%)
FOURTH SLIDER -1 SETTING (Allfr=95%)

| | RATED DISCHARGE VOLUME | ACTUAL DISCHARGE VOLUME | EQUATION |
|---|---|---|---|
| BLACK | 25 | 23.8 | Bkvq=(Bkrq=25) x (Allfr=95%) x (Bkfr=95%) EQUATION (3) |
| CYAN | 25 | 25.4 | Bkaq=(Bkrq=25) x (Allfr=95%) EQUATION (4)<br>CMYaq=(CMYrq=25) x (Allfr=95%) EQUATION (5)<br>CMYvq=(CMYaq=23.8) + ((Bkrq=25) - (Bkaq=23.8))/3 EQUATION (6) |
| MAGENTA | 25 | 25.4 | Bkaq=(Bkrq=25) x (Allfr=95%) EQUATION (4)<br>CMYaq=(CMYrq=25) x (Allfr=95%) EQUATION (5)<br>CMYvq=(CMYaq=23.8) + ((Bkrq=25) - (Bkaq=23.8))/3 EQUATION (6) |
| YELLOW | 25 | 25.4 | Bkaq=(Bkrq=25) x (Allfr=95%) EQUATION (4)<br>CMYaq=(CMYrq=25) x (Allfr=95%) EQUATION (5)<br>CMYvq=(CMYaq=23.8) + ((Bkrq=25) - (Bkaq=23.8))/3 EQUATION (6) |
| TOTAL INK DISCHARGE VOLUME | 100 | 100 | |

PRINT CONTROL DEVICE, CONTROL METHOD OF A POSITIONING DATA, AND POSITIONING SYSTEM

Priority is claimed under 35 U.S.C. §119 from Japanese patent application nos. JP 2013-015203 filed on Jan. 30, 2013 and JP 2013-053230 filed on Mar. 15, 2013, which are hereby incorporated by reference in their entirety.

BACKGROUND

1. Technical Field

The present disclosure relates to a print control device, a control method of a printing device, and a printing system that adjusts the amount of ink deposited on the recording medium when printing with plural inks.

2. Related Art

Bleeding can occur in the printed image when printing with an inkjet printer. Bleeding can be suppressed when this happens by reducing the amount of ink that is deposited on the recording medium for printing (the discharge volume) and reducing the print density. The print density is also reduced by reducing the amount of each ink that is deposited when suppressing the discharge volume of each ink used for printing is desirable. JP-A-2009-141941 discloses an image processing method that reduces the print density without changing the hue.

As taught in JP-A-2006-279922, some inkjet printers use both black ink and chromatic color inks such as cyan ink, magenta ink, and yellow ink for printing. This type of inkjet printer discharges chromatic ink from the inkjet head in addition to black ink when forming a black area on the recording medium.

Some inkjet printers print using chromatic color inks such as cyan, magenta, and yellow, and black ink. Each ink contains pigment or other color material, resin, and solvent, and the water resistance and scratch-fastness (adhesiveness of ink droplets to the print medium) of the ink differs according to the specific constituents, the content ratio, and the amount of each constituent. Because the water resistance and scratch-fastness of black ink is generally inferior to chromatic ink due, for example, to the amount of color material, the amount of black ink deposited onto the recording medium is sometimes reduced in order to improve the water resistance and scratch-fastness of the printed image.

When bleeding in the print image or ink consumption is suppressed by reducing at a uniform rate the amount of each ink (cyan ink, magenta ink, yellow ink, black ink) that is deposited when printing by the inkjet printer, deposition of a specific ink (black ink) may be further reduced in order to improve the water resistance and scratch-fastness of the printed image. In this event, however, how to determine the deposition volume of the specific ink that is thus twice adjusted is a problem.

Furthermore, if the discharge volume of black ink is reduced according to a user setting, missing dots can occur where dots are not formed on the recording medium. For example, dots can be missing in black lines formed on the recording medium. Dots can also be missing in the contours of graphic objects formed on the recording medium, and image contours can be lost.

SUMMARY

When the discharge volume of a specific ink is additionally adjusted while uniformly adjusting the deposition volume (discharge volume) of each ink, a print control device, a control method of a printing device, and a printing system according to at least one embodiment of the present invention can determine a corrected deposition volume for depositing the specific ink while printing.

A print control device, a control method of a printing device, and a printing system according to at least one embodiment of the present invention can also suppress the appearance of missing dots in the printout when reducing the discharge volume of a specific ink in the group of plural inks used for printing.

One aspect of at least one embodiment of the present invention is a print control device that controls a recording device that discharges a plurality of inks and records on a recording medium, the print control device including: a total correction ratio input unit that receives input of a total correction ratio for uniformly correcting the discharge volume of each ink; and a specific correction ratio input unit that receives input of a specific correction ratio for correcting the discharge volume of one specific ink in the group of plural inks.

While uniformly adjusting the discharge volume (deposition volume) of each ink, this aspect of the invention enables easily additionally adjusting the discharge volume (deposition volume) of a specific ink.

Note that the discharge volume as used herein refers primarily to the amount of ink discharged from the inkjet head based on the amount of ink consumed when printing. The deposition volume refers mainly to the amount of ink that lands on the recording paper based on the amount of ink consumed when printing.

The print control device preferably also has a discharge volume correction unit that corrects the discharge volume of the specific ink based on a value calculated from the total correction ratio and the specific correction ratio to determine a corrected discharge volume for discharging the specific ink when printing.

This aspect of at least one embodiment of the present invention can easily determine the corrected discharge volume for discharging the specific ink when printing by correcting the rated discharge volume of the specific ink based on a value calculated from the total correction ratio and the specific correction ratio.

Yet further preferably, the total correction ratio input unit displays a total correction ratio input screen to receive input of the total correction ratio; and the specific correction ratio input unit displays a specific correction ratio input screen to receive input of the specific correction ratio.

This aspect of at least one embodiment of the present invention facilitates receiving the total correction ratio and the specific correction ratio.

The calculated value is the product of the total correction ratio and the specific correction ratio. This enables reducing the discharge volume of the specific ink more than the discharge volume of the other inks when adjusting the discharge volume of the specific ink in addition to uniformly adjusting the discharge volume of each ink.

In another aspect of at least one embodiment of the present invention, the specific ink has at least one of inferior water resistance and scratch-fastness than the other inks. This aspect of at least one embodiment of the present invention enables improving the water resistance or scratch-fastness of the printed image while suppressing ink consumption and ink bleeding in the printed image by uniformly adjusting the discharge volume of each ink.

In another aspect of at least one embodiment of the present invention, the plural inks are cyan ink, magenta ink, yellow ink, and black ink; and the specific ink is black ink. The water resistance and scratch-fastness of black ink is generally inferior to the water resistance and scratch-fastness of chromatic inks because of the difference in the amount of color material, for example. This aspect of the invention can therefore improve the water resistance and scratch-fastness of the printed image while suppressing bleeding in the printed image and ink consumption by uniformly adjusting the discharge volume of each ink.

Another aspect of at least one embodiment of the present invention is a control method of a printing device that discharges a plurality of inks and records on a recording medium, the control method including: receiving input of a total correction ratio that uniformly corrects a discharge volume of each ink, and receiving input of a specific correction ratio that corrects the discharge volume of one specific ink in the group of plural inks; and correcting the discharge volume of the specific ink based on a value calculated from the total correction ratio and the specific correction ratio, and determining a corrected discharge volume for discharging the specific ink when printing.

When a total correction ratio that uniformly adjusts the discharge volume of each ink, and the specific correction ratio that adjusts the discharge volume of a specific ink, are input, this aspect of the invention can easily determine a corrected discharge volume for the specific ink.

The control method of a printing device according to another aspect of at least one embodiment of the present invention preferably also displays a total correction ratio input screen to receive input of the total correction ratio, and a specific correction ratio input screen to receive input of the specific correction ratio. This facilitates receiving the total correction ratio and the specific correction ratio.

Yet further preferably, the calculated value is the product of the total correction ratio and the specific correction ratio. This enables reducing the discharge volume of the specific ink more than the discharge volume of the other inks when adjusting the discharge volume of the specific ink in addition to uniformly adjusting the discharge volume of each ink.

Another aspect of at least one embodiment of the present invention is a printing system including the print control device described above, and a printing device that is connected to the print control device and records on a recording medium by discharging a plurality of inks.

When the total correction ratio for uniformly adjusting the discharge volume of each ink, and a specific correction ratio for adjusting the discharge volume of a specific ink, are set on the print control device side, this aspect of the invention can easily determine the corrected discharge volume of the specific ink discharged by the printing device when printing.

The print control device according to another aspect of at least one embodiment of the present invention also has an actual discharge volume setting unit that, based on at least one of the specific correction ratio that reduces the discharge volume of one specific ink in the group of plural inks from the rated discharge volume of the specific ink, and the total correction ratio that reduces the discharge volume of each of the plural inks uniformly from the rated discharge volume of each ink, determines the actual discharge volume at which the printing device discharges the specific ink by reducing the rated discharge volume of the specific ink, and determines the actual discharge volumes at which the printing device discharges each of the other inks by increasing the rated discharge volume of each of the inks other than the specific ink in the group of plural inks.

When the discharge volume of the specific ink is reduced, this aspect of the invention compensates for part or all of the reduction in the specific ink by increasing the discharge volume of the other inks. The appearance of missing dots in the printout can therefore be suppressed because dots missing in the printout due to the reduction in the discharge volume of the specific ink can be covered by discharging the other inks.

Preferably, the print control device also has a correction ratio receiving unit that accepts at least one of the specific correction ratio and the total correction ratio; and the actual discharge volume setting unit includes a first actual discharge volume setting unit and a second actual discharge volume setting unit. When only the specific correction ratio is received, the first actual discharge volume setting unit determines an actual discharge volume at which the printing device discharges the specific ink by reducing the rated discharge volume of the specific ink based on the specific correction ratio, and determines the actual discharge volume at which the printing device discharges each of the other inks by increasing the rated discharge volume of each ink other than the specific ink in the group of plural inks. When the total correction ratio is received, the second actual discharge volume setting unit determines the actual discharge volume of the specific ink by reducing the rated discharge volume of the specific ink based on the total correction ratio and the specific correction ratio, and determines the actual discharge volume of the other inks by calculating the corrected discharge volume that reduces the rated discharge volume of each of the other inks based on the total correction ratio, and increasing each corrected discharge volume.

When a specific correction ratio that reduces only the discharge volume of the specific ink is received, the actual discharge volume of the inks other than the specific ink is increased above the rated discharge volume. When a total correction ratio that decreases the discharge volume of all inks is received, the actual discharge volume of the other inks becomes greater than the corrected discharge volume to which the rated discharge volume is decreased based on the total correction ratio. More specifically, when the discharge volume of the specific ink is reduced, part or all of the decrease in the specific ink is compensated for by increasing the discharge volume of the other inks. The appearance of missing dots in the printout can therefore be suppressed because dots missing in the printout due to the reduction in the discharge volume of the specific ink can be covered by discharging the other inks.

To increase the discharge volume of the other inks when only a specific correction ratio that reduces the discharge volume of the specific ink is received, the first actual discharge volume setting unit preferably increases the rated discharge volume of each other ink based on the difference between the rated discharge volume of the specific ink and the actual discharge volume of the specific ink.

In this aspect of at least one embodiment of the present invention the difference between the rated discharge volume of the specific ink and the actual discharge volume of the specific ink can be made equal to the total difference between the actual discharge volume and the rated discharge volume of each of the other inks. The decrease in the discharge volume of the specific ink, which is reduced based on the specific correction ratio, can be compensated for by increasing the discharge volume of the other inks. When the discharge volume of the specific ink is reduced, the total discharge volume of the specific ink and other inks combined can be maintained equal to the volume discharged when each ink is discharged at the rated discharge volume.

To increase the actual discharge volume of the other inks greater than the corrected discharge volume when a total correction ratio that reduces total discharge volume of all ink is input, the second actual discharge volume setting unit in another aspect of at least one embodiment of the present invention increases the corrected discharge volume of each other ink based on the difference between the rated discharge volume of the specific ink and the specific corrected discharge volume to which the rated discharge volume of the specific ink is reduced based on the total correction ratio.

Further preferably, the difference between the rated discharge volume and the specific corrected discharge volume of the specific ink is equal to the total of the differences between the actual discharge volume and the corrected discharge volume of each of the other inks. This aspect of at least one embodiment of the present invention can compensate for the decrease in the discharge of the specific ink based on the total correction ratio by increasing the discharge volume of the other inks.

Further preferably, the correction ratio receiving unit displays a correction ratio input screen for receiving the total correction ratio and the specific correction ratio. In this event, input of the specific correction ratio and the total correction ratio can be easily received.

Another aspect of at least one embodiment of the present invention is a control method of a printing device that prints by discharging a plurality of inks onto a recording medium, the control method including: based on at least one of the specific correction ratio that reduces the discharge volume of one specific ink in the group of plural inks from the rated discharge volume of the specific ink, and the total correction ratio that reduces the discharge volume of each of the plural inks uniformly from the rated discharge volume of each ink, determining the actual discharge volume at which the specific ink is discharged when printing by reducing the rated discharge volume of the specific ink, and determining the actual discharge volumes at which each of the other inks are discharged when printing by increasing the rated discharge volume of each of the inks other than the specific ink in the group of plural inks.

When the discharge volume of the specific ink is reduced, part or all of the decrease in the specific ink is compensated for by increasing the volume of other inks discharged. The appearance of missing dots in the printout can therefore be suppressed because dots missing in the printout due to the reduction in the discharge volume of the specific ink can be covered by discharging the other inks.

The control method of a printing device according to another aspect of at least one embodiment of the present invention further includes receiving at least one of the specific correction ratio and the total correction ratio; determining an actual discharge volume at which the printing device discharges the specific ink by reducing the rated discharge volume of the specific ink based on the specific correction ratio, and determining the actual discharge volume at which the printing device discharges each of the other inks by increasing the rated discharge volume of each ink other than the specific ink in the group of plural inks, when only the specific correction ratio is received; and determining the actual discharge volume of the specific ink by reducing the rated discharge volume of the specific ink based on the total correction ratio and the specific correction ratio, and determining the actual discharge volume of the other inks by calculating the corrected discharge volume that reduces the rated discharge volume of each of the other inks based on the total correction ratio, and increasing each corrected discharge volume, when the total correction ratio is received.

When a specific correction ratio that reduces only the discharge volume of the specific ink is received, the actual discharge volume of the inks other than the specific ink is increased above the rated discharge volume. When a total correction ratio that decreases the discharge volume of all inks is received, the actual discharge volume of the other inks becomes greater than the corrected discharge volume to which the rated discharge volume is decreased based on the total correction ratio. More specifically, when the discharge volume of the specific ink is reduced, part or all of the decrease in the specific ink is compensated for by increasing the discharge volume of the other inks. The appearance of missing dots in the printout can therefore be suppressed because dots missing in the printout due to the reduction in the discharge volume of the specific ink can be covered by discharging the other inks.

To increase the discharge volume of other inks when only the specific correction ratio that reduces the discharge volume of the specific ink is input, the control method of at least one embodiment of the present invention further includes increasing the rated discharge volume of each other ink based on the difference between the rated discharge volume of the specific ink and the actual discharge volume of the specific ink when only the specific correction ratio is received.

Another aspect of at least one embodiment of the present invention is a printing system including: the printing control device described above; and a printing device that is connected to the print control device and records on a recording medium by discharging a plurality of inks.

This aspect of at least one embodiment of the present invention can suppress or prevent missing dots in the printout when the discharge volume of a specific ink is reduced in a group of plural inks used for printing. Other objects and attainments together with a fuller understanding of at least one embodiment of the present invention will become apparent and appreciated by referring to the following description and claims taken in conjunction with the accompanying drawings.

BRIEF DESCRIPTION OF THE DRAWINGS

FIG. 3 describes a density adjustment table.

FIG. 7A describes the discharge volume setting operation whereby an actual discharge volume setting unit sets the actual discharge volume.

FIG. 7B describes the discharge volume setting operation whereby an actual discharge volume setting unit sets the actual discharge volume.

FIG. 7C describes the discharge volume setting operation whereby an actual discharge volume setting unit sets the actual discharge volume.

DESCRIPTION OF EMBODIMENTS

Embodiment 1

At least one embodiment of the present invention is described below with reference to FIG. 1 to FIG. 4.

Printing System

Figure 1:
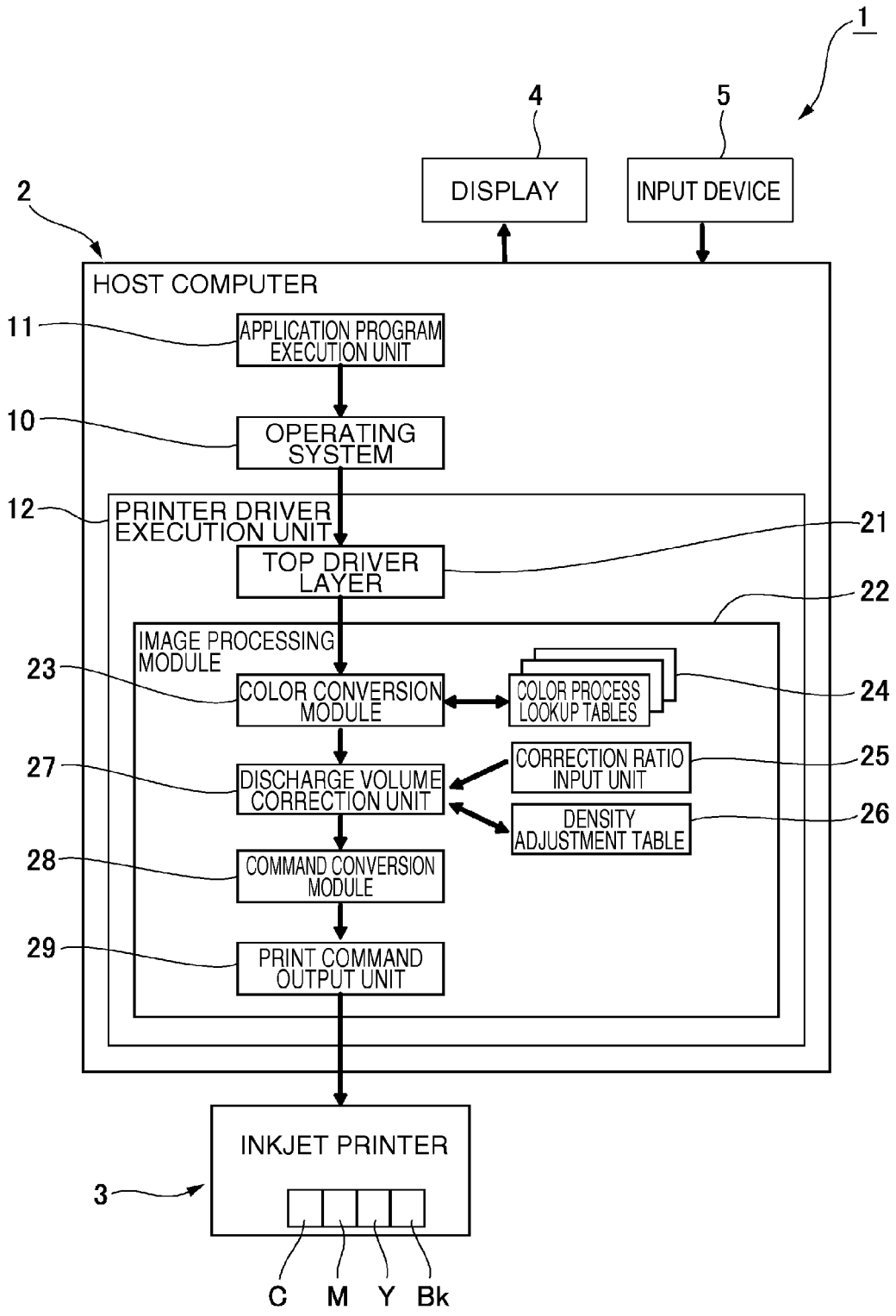
FIG. 1 is a schematic block diagram of a printing system according to some embodiments.

FIG. 1 is a schematic block diagram of a printing system according to at least one embodiment of the present invention. The printing system 1 includes a host computer (print control device) 2, and an inkjet printer (printing device) 3 connected to the host computer 2. A display 4 and an input device 5 such as a keyboard or mouse are also connected to the host computer 2.

The host computer 2 has an operating system 10, an application program execution unit 11, and a printer driver execution unit 12. The application program execution unit 11 runs software for creating image data. The printer driver execution unit 12 receives image data output from the application program execution unit 11 through the operating system 10. The printer driver execution unit 12 produces print commands (print data) based on the image data, and outputs the print commands to the inkjet printer 3. The host computer 2 controls driving the inkjet printer 3 to print the image based on the print commands.

The inkjet printer 3 prints with four colors of ink, cyan ink C, magenta ink M, yellow ink Y, and black ink Bk. Each of the inks (cyan ink C, magenta ink M, yellow ink Y, and black ink Bk) contains color material, solvent, and resin, and the water resistance and scratch-fastness (adhesion of ink droplets to the print medium) of each ink differs according to the specific constituents, the content ratio, and the amount of each constituent in the ink. In this example, the water resistance and scratch-fastness of the black ink Bk is inferior to the chromatic inks (cyan ink C, magenta ink M, yellow ink Y). The water resistance and scratch-fastness of the black ink Bk is inferior because it contains more color material than the chromatic inks (cyan ink C, magenta ink M, yellow ink Y) in order to absorb more visible light, and when an ink droplet discharged from the inkjet head (not shown in the figure) lands on the recording paper (recording medium), the pigment that stops in the surface layer of the recording paper becomes raised up.

Printer Driver Execution Unit

As shown in FIG. 1, the printer driver execution unit 12 has a top driver layer 21 and an image processing module 22. The top driver layer 21 renders the image data supplied from the application program execution unit 11, and converts each pixel in the image data to RGB gray scale data. The image processing module 22 converts the RGB gray scale data supplied from the top driver layer 21 to ink volume data for each ink, converts the ink volume data to print commands, and outputs the print commands to the inkjet printer 3. The image processing module 22 includes a color conversion module 23, color process LUTs (lookup tables) 24, correction ratio input unit 25, density adjustment table 26, discharge volume correction unit 27, command conversion module 28, and print command output unit 29.

The color conversion module 23 refers to the color process LUTs 24 to convert the RGB gray scale data for each pixel to ink volume data for each color of ink (cyan ink C, magenta ink M, yellow ink Y, and black ink Bk). The ink volume data for each ink output from the color conversion module 23 corresponds to the discharge volume (deposition volume) of each ink when printing the pixels in the image data on the recording paper. The ink volume data of each ink immediately after output from the color conversion module 23 corresponds to the rated discharge volume (rated deposition volume) used for reference. Note that the image processing module 22 in this example has a plurality of color process LUTs 24, and selects one color process LUT 24 corresponding to the print mode previously selected by the user.

Note that the discharge volume as used here refers primarily to the amount of ink discharged from the inkjet head, and the deposition volume refers mainly to the amount of ink that lands on the recording paper, but this embodiment of the invention does not strictly differentiate the discharge volume and the deposition volume.

The correction ratio input unit 25 (total correction ratio input unit and specific correction ratio input unit) displays a dialog box on the display 4, and accepts input of the total correction ratio that uniformly corrects the discharge volume of each ink (cyan ink C, magenta ink M, yellow ink Y, and black ink Bk), and accepts input of the specific correction ratio that corrects the discharge volume of black ink Bk (specific ink).

Figure 2:
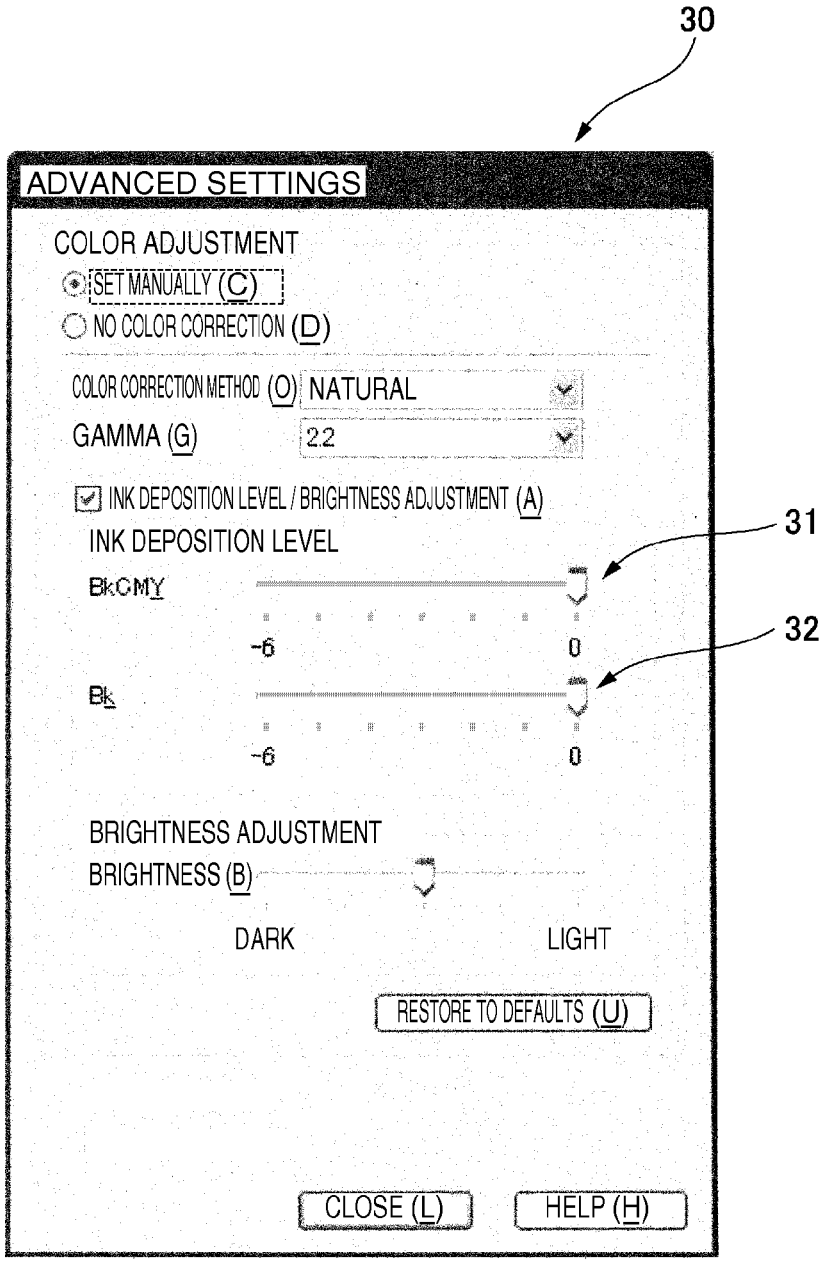
FIG. 2 describes a dialog box displayed by a printer driver.

FIG. 2 describes the dialog box that the correction ratio input unit 25 displays on the display 4. The dialog box 30 has a first slider 31 for accepting input of the total correction ratio, and a second slider 32 that accepts input of the specific correction ratio.

The first slider 31 is normally set to 0 on the scale. The total correction ratios for correcting the rated discharge volume correspond to markers −1 to −6 on the scale of the first slider 31. When the first slider 31 is moved and set to the desired position (setting), the amount of each ink discharged to the recording paper is uniformly corrected (reduced) by the total correction ratio corresponding to the setting. Because this reduces the print density, the first slider 31 is moved in order to suppress bleeding in the print image. Furthermore, because the discharge volume of each ink to the recording paper is uniformly reduced at the total correction ratio corresponding to the setting when the first slider 31 is moved to the desired position (setting), the first slider 31 is also operated in order to reduce consumption of each ink. When the first slider 31 is operated alone, the corrected discharge volume of each ink (cyan ink C, magenta ink M, yellow ink Y, and black ink Bk) equals the product of the actual discharge volume of each ink multiplied by the total correction ratio corresponding to the setting.

The second slider 32 is normally set to 0 on the scale. The specific correction ratio for correcting the rated discharge volume of ink corresponds to markers −1 to −6 on the scale of the second slider 32. When the second slider 32 is moved and set to the desired position (setting), the amount of black ink Bk, which is inferior to the other inks in water resistance and scratch-fastness, that is discharged is corrected (reduced) by the specific correction ratio corresponding to the setting. Because this results in a relative improvement in the water resistance and scratch-fastness of the printed image, the second slider 32 is operated when improving the water resistance and scratch-fastness of the printed image is desirable. When the second slider 32 is operated alone, the corrected discharge volume of black ink Bk equals the product of the actual discharge volume of black ink Bk multiplied by the specific correction ratio corresponding to the setting.

To suppress bleeding in the printed image and improve the water resistance and scratch-fastness of the printed image, both the first slider 31 and second slider 32 are operated. In this event, the corrected discharge volume of each chromatic ink (cyan ink C, magenta ink M, yellow ink Y) becomes the product of the rated discharge volume of each chromatic ink multiplied by the total correction ratio corresponding to the set position of the first slider 31. The corrected discharge volume of black ink Bk becomes the product of the rated discharge volume of black ink Bk multiplied by the correction ratio multiple (product)), which is equal to the product of the total correction ratio corresponding to the set position of the first slider 31 and the specific correction ratio corresponding to the set position of the second slider 32.

The density adjustment table 26 stores the relationship between the first slider 31 setting, second slider 32 setting, total correction ratio, specific correction ratio, and the correction ratio multiple. FIG. 3 describes the density adjustment table 26.

As shown in FIG. 3, when the second slider 32 is set to 0 and the first slider 31 is set to 0, the total correction ratio is 100%. When the first slider 31 is set to −1, the total correction ratio is 95%. When the first slider 31 is set to −2, the total correction ratio is 90%. When the first slider 31 is set to −3, the total correction ratio is 85%. When the first slider 31 is set to −4, the total correction ratio is 80%. When the first slider 31 is set to −5, the total correction ratio is 75%. When the first slider 31 is set to −6, the total correction ratio is 70%.

As also shown in the right column (black column) in FIG. 3 when the first slider 31 is set to 0, when the second slider 32 is set to 0, the specific correction ratio is 100%. When the second slider 32 is set to −1, the specific correction ratio is 95%. When the second slider 32 is set to −2, the specific correction ratio is 90%. When the second slider 32 is set to −3, the specific correction ratio is 85%. When the second slider 32 is set to −4, the specific correction ratio is 80%. When the second slider 32 is set to −5, the specific correction ratio is 75%. When the second slider 32 is set to −6, the specific correction ratio is 70%.

The correction ratio multiples for correcting the black ink Bk level are shown in the right-hand column (column for black) of each row of the first slider 31 settings −1 to −6 in FIG. 3. The correction ratio multiple is the product of the total correction ratio corresponding to the setting of the first slider 31 multiplied by the specific correction ratio corresponding to the setting of the second slider 32.

The discharge volume correction unit 27 references the density adjustment table 26 based on the setting of the first slider 31 and the setting of the second slider 32, and acquires the corresponding correction ratios (total correction ratio, specific correction ratio, correction ratio multiple) from the density adjustment table 26. The discharge volume correction unit 27 then corrects the rated discharge volume of each ink based on the acquired correction ratios (total correction ratio, specific correction ratio, correction ratio multiple). More specifically, the discharge volume correction unit 27 calculates the corrected discharge volume of each ink by multiplying the rated discharge volume of each ink times the correction ratio (one of the total correction ratio, specific correction ratio, and correction ratio multiple).

For example, when the first slider 31 and second slider 32 are not adjusted, the discharge volume correction unit 27 gets the total correction ratio (100%) from the density adjustment table 26. The corrected discharge volume of each ink (cyan ink C, magenta ink M, yellow ink Y, and black ink Bk) output from the discharge volume correction unit 27 is therefore the rated discharge volume. More specifically, the discharge volume correction unit 27 sets the corrected discharge volume of each ink to 100% of the rated discharge volume.

When only the first slider 31 is operated and is set to −2, for example, and the second slider 32 remains set to 0, the discharge volume correction unit 27 gets a total correction ratio of 90% from the density adjustment table 26. The discharge volume correction unit 27 therefore sets the corrected discharge volume of each ink (cyan ink C, magenta ink M, yellow ink Y, and black ink Bk) to 90% of the rated discharge volume.

When only the second slider 32 is set to −2, and the first slider 31 is set to 0, the discharge volume correction unit 27 gets the total correction ratio (100%) and the specific correction ratio (90%) from the density adjustment table 26. The discharge volume correction unit 27 therefore sets the corrected discharge volume of the chromatic inks (cyan ink C, magenta ink M, yellow ink Y) to 100% of the rated discharge volume, and sets the corrected discharge volume of black ink Bk to 90% of the rated discharge volume.

If both the first slider 31 and second slider 32 are adjusted so that the first slider 31 is set to −2 and the second slider 32 is set to −3, the discharge volume correction unit 27 gets the total correction ratio (90%) and the correction ratio multiple (77%) from the density adjustment table 26. As a result, the discharge volume correction unit 27 sets corrected discharge volume of the chromatic inks (cyan ink C, magenta ink M, yellow ink Y) to 90% of the rated discharge volume, and sets the corrected discharge volume of black ink Bk to 77% of the rated discharge volume. The corrected discharge volume of the black ink Bk therefore goes to 77% of the rated discharge volume. When both the first slider 31 and second slider 32 are thus operated, the discharge volume correction unit 27 sets the corrected discharge volume of each ink to a level lower than the rated discharge volume, and sets the corrected discharge volume of black ink Bk, which has relatively lower water resistance and scratch-fastness, lower than the corrected discharge volume of the chromatic inks. Note that the correction ratio multiple of 77% in this example is the product of the total correction ratio (90%) when the first slider 31 is set to −2 multiplied by the specific correction ratio (85%) when the second slider 32 is set to −3.

The command conversion module 28 converts the ink volume data (corrected discharge volume) of each ink used to print each pixel to a print command. Note that this embodiment uses three sizes of ink droplets (large, medium, small) as the ink droplets that are discharged to the recording paper from the inkjet head when depositing ink onto the recording paper, and the volume of each ink discharged to the recording paper is adjusted by a print command that controls the ratio of ink droplets of each size (large, medium, small).

The print command output unit 29 outputs the print commands produced by the command conversion module 28 to the inkjet printer 3. The inkjet printer 3 then controls operation according to the print commands, and prints an image on the recording paper.

Image Data Printing Process

Figure 4:
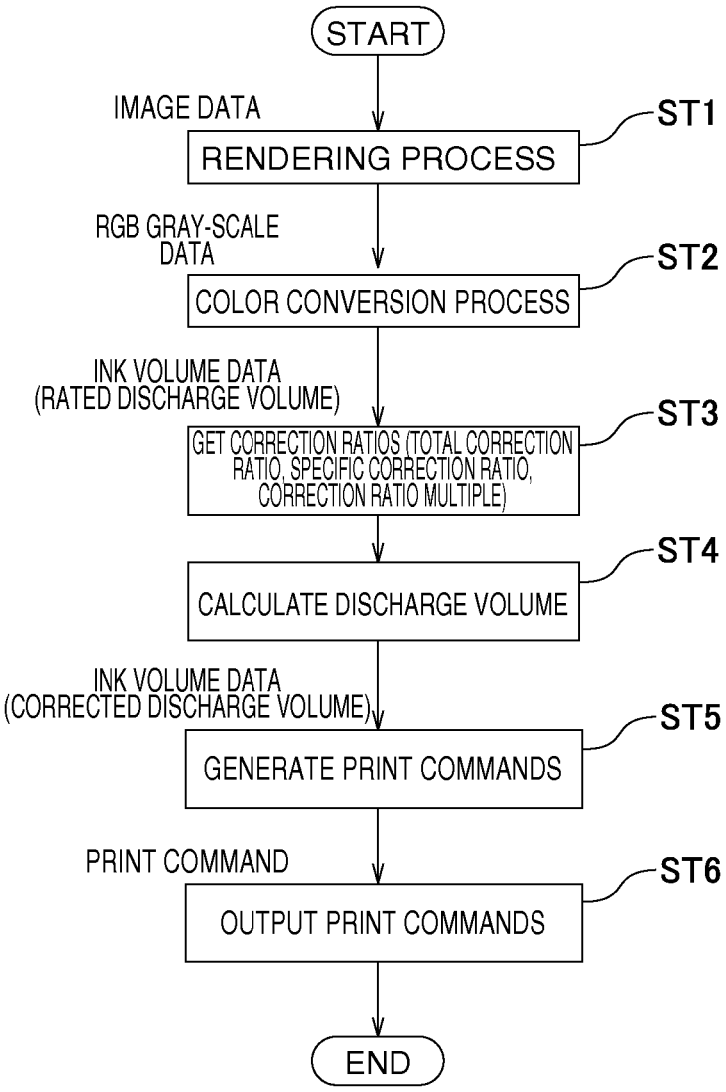
FIG. 4 is a flow chart if the printing process in the printing system.

FIG. 4 is a flow chart of the image data printing process in at least one embodiment of the present invention. In this example, the first slider 31 and second slider 32 have been moved by the user and set to a desirable setting when the printer driver execution unit 12 receives image data supplied from the application program execution unit 11. When the printer driver execution unit 12 then receives the image data from the application program execution unit 11, the top driver layer 21 applies a rendering process to the image data and converts each pixel to RGB gray-scale data (step ST1). When the RGB gray-scale data is output from the top driver layer 21, the color process module executes a color conversion process that converts the RGB gray-scale data to ink volume data (rated discharge volume) for each color of ink by means of the color process LUTs 24 (step ST2).

The discharge volume correction unit 27 then checks the setting of the first slider 31 and the setting of the second slider 32. The discharge volume correction unit 27 then references the density process table based on the setting of the first slider 31 and the setting of the second slider 32, and gets the correction ratios (total correction ratio, specific correction ratio, correction ratio multiple) (step ST3). The discharge volume correction unit 27 also multiples the ink volume data (rated discharge volume) for each ink by the appropriate correction ratio (total correction ratio, specific correction ratio, or correction ratio multiple), and calculates the ink volume data (corrected discharge volume) for each ink used for printing (step ST4).

Once the ink volume data (corrected discharge volume) is calculated for each ink used for printing, the command conversion module 28 generates the print commands based on the calculated ink volume data (corrected discharge volume) (step ST5). The print command output unit 29 then outputs the generated print commands to the inkjet printer 3 (step ST6). The inkjet printer 3 then controls operation according to the print commands and prints an image.

When adjusting the discharge volume of black ink Bk by a specific correction ratio while adjusting the discharge volume of each ink (cyan ink C, magenta ink M, yellow ink Y, and black ink Bk) by the total correction ratio from the rated discharge volume, this embodiment of the invention determines the corrected discharge volume for black ink Bk by correcting the rated discharge volume of black ink Bk using a correction ratio multiple obtained by multiplying the total correction ratio by the specific correction ratio. The corrected discharge volume used to deposit black ink Bk when printing can therefore be easily determined. In addition, because the rated discharge volume of black ink Bk is corrected using a correction ratio multiple, the volume of black ink Bk, which has inferior water resistance and scratch-fastness, can be reduced greater than the discharge volume of chromatic ink while reducing the total ink discharge volume. Bleeding in the printed image and ink consumption can therefore be suppressed while improving the water resistance and scratch-fastness of the printed image.

In this example a dialog box 30 is displayed on the display 4 to receive input of the total correction ratio and the specific correction ratio. The user can therefore easily suppress bleeding in the printed image and consumption of ink. The user can also easily adjust the water resistance and scratch-fastness of the printed image.

At least one embodiment of the present invention corrects the rated discharge volume of black ink Bk using a correction ratio multiple obtained by multiplying the total correction ratio and specific correction ratio when both the first slider 31 and second slider 32 are adjusted, but could be corrected using a correction ratio previously calculated by substituting the total correction ratio and specific correction ratio into a predetermined equation.

This first embodiment also stores correction ratio multiples in a table format, but when the first slider 31 and second slider 32 are both operated, the correction ratio multiple could be obtained by multiplying the total correction ratio corresponding to the first slider 31 setting with the specific correction ratio corresponding to the setting of the second slider 32. The discharge volume of black ink Bk is corrected in the first embodiment by operating the second slider 32, but a configuration in which operating the second slider 32 adjusts the discharge volume of one of the chromatic inks is also conceivable.

Embodiment 2

At least one embodiment of the present invention is described next with reference to FIG. 5 to FIG. 8. Note that aspects of the configuration and content that are the same as in the first embodiment are identified with like reference numerals below and in the figures.

Printing System

Figure 5:
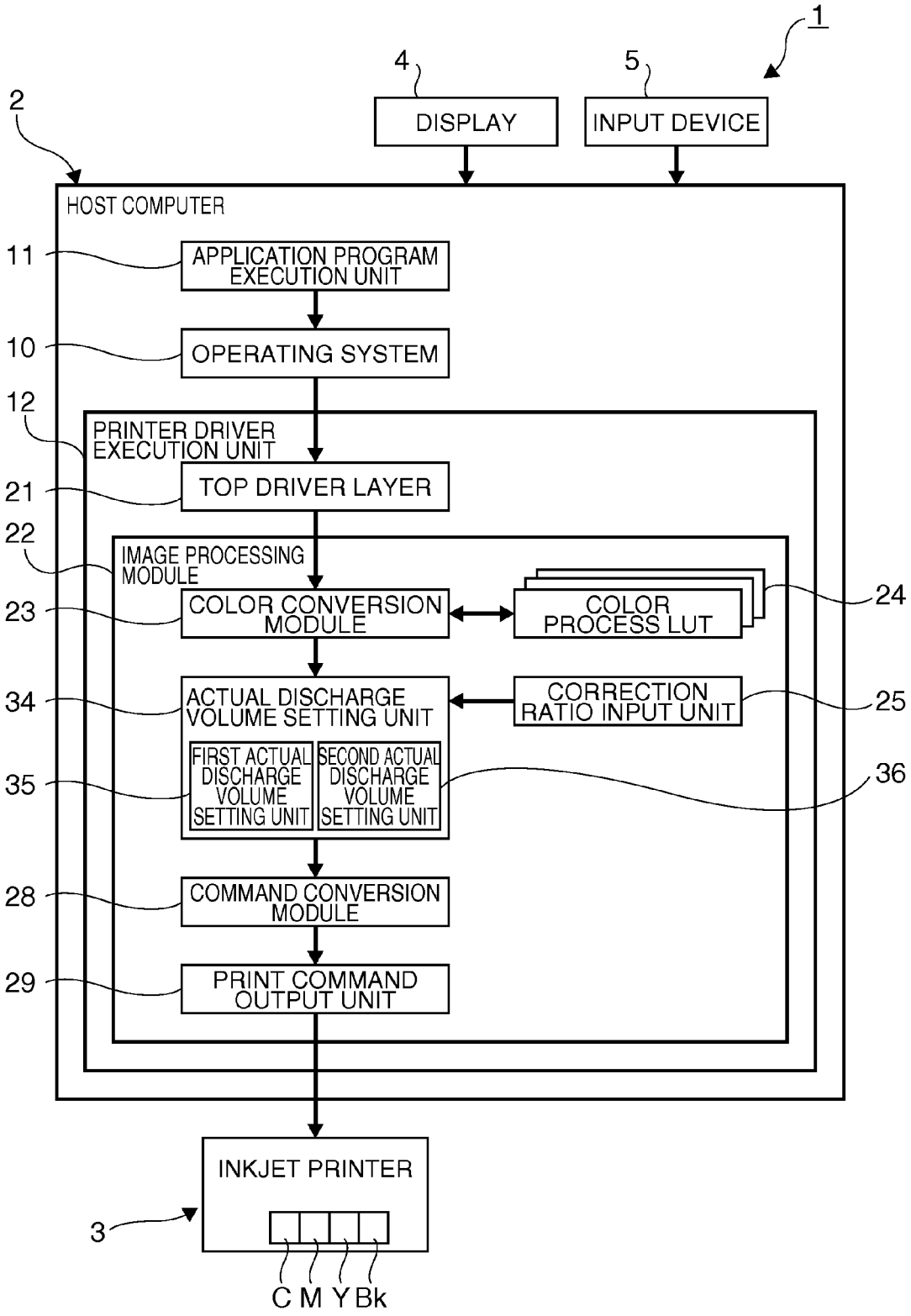
FIG. 5 is a schematic block diagram of a printing system according to some embodiments.

FIG. 5 is a schematic block diagram of a printing system according to at least one embodiment of the present invention. The printing system 1 according to this embodiment includes a host computer (print control device) 2, and an inkjet printer (printing device) 3 connected to the host computer 2. A display 4 and an input device 5 such as a keyboard or mouse are also connected to the host computer 2.

The host computer 2 has an operating system 10, an application program execution unit 11, and a printer driver execution unit 12. The application program execution unit 11 runs software for creating image data. The printer driver execution unit 12 receives image data output from the application program execution unit 11 through the operating system 10. The printer driver execution unit 12 produces print commands (print data) based on the image data, and outputs the print commands to the inkjet printer 3. The host computer 2 controls driving the inkjet printer 3 to print 2D code symbols or images based on the print commands.

The inkjet printer 3 prints with four colors of ink, cyan ink C, magenta ink M, yellow ink Y, and black ink Bk. When forming black lines or areas on the recording paper, the inkjet printer 3 according to this embodiment of the invention discharges chromatic colors of ink C, M, Y (cyan ink C, magenta ink M, yellow ink Y) from the inkjet head in addition to black ink Bk.

Each of the inks C, M, Y, Bk (cyan ink C, magenta ink M, yellow ink Y, and black ink Bk) contains color material, solvent, and resin, and the water resistance and scratch-fastness (adhesion of ink droplets to the print medium) of each ink differs according to the specific constituents, the content ratio, and the amount of each constituent in the ink. In this example, the water resistance and scratch-fastness of the black ink Bk is inferior to the chromatic inks C, M, Y. The water resistance and scratch-fastness of the black ink Bk is inferior because black ink Bk contains more color material than the chromatic inks C, M, Y in order to absorb more visible light, and when an ink droplet discharged from the inkjet head (not shown in the figure) lands on the recording paper (recording medium), the pigment that stops in the surface layer of the recording paper becomes raised up.

Printer Driver Execution Unit

As shown in FIG. 5, the printer driver execution unit 12 has a top driver layer 21 and an image processing module 22. The top driver layer 21 renders the image data supplied from the application program execution unit 11, and converts each pixel in the image data to RGB gray scale data. The image processing module 22 converts the RGB gray scale data supplied from the top driver layer 21 to ink volume data for each ink C, M, Y, Bk, converts the ink volume data to print commands, and outputs the print commands to the inkjet printer 3. The image processing module 22 includes a color conversion module 23, color process LUTs (lookup tables) 24, correction ratio input unit 25, actual discharge volume setting unit 34, command conversion module 28, and print command output unit 29.

The color conversion module 23 refers to the color process LUTs 24 to convert the RGB gray scale data for each pixel to ink volume data for each color of ink C, M, Y, and Bk. The ink volume data for each ink C, M, Y, and Bk output from the color conversion module 23 is the rated discharge volume (deposition volume) of each ink C, M, Y, and Bk when printing the pixels in the image data on the recording paper. Note that the image processing module 22 in this example has a plurality of color process LUTs 24, and selects one color process LUT 24 corresponding to the print mode previously selected by the user.

Note that the discharge volume as used here refers primarily to the amount of ink discharged from the inkjet head, and the deposition volume refers mainly to the amount of ink that lands on the recording paper, but this embodiment of the invention does not strictly differentiate the discharge volume and the deposition volume.

The correction ratio input unit 25 displays a dialog box on the display 4, accepts input of the specific correction ratio that corrects the discharge volume of black ink Bk (specific ink), and accepts input of the total correction ratio that uniformly corrects the discharge volume of each ink C, M, Y, and Bk.

Figure 6:
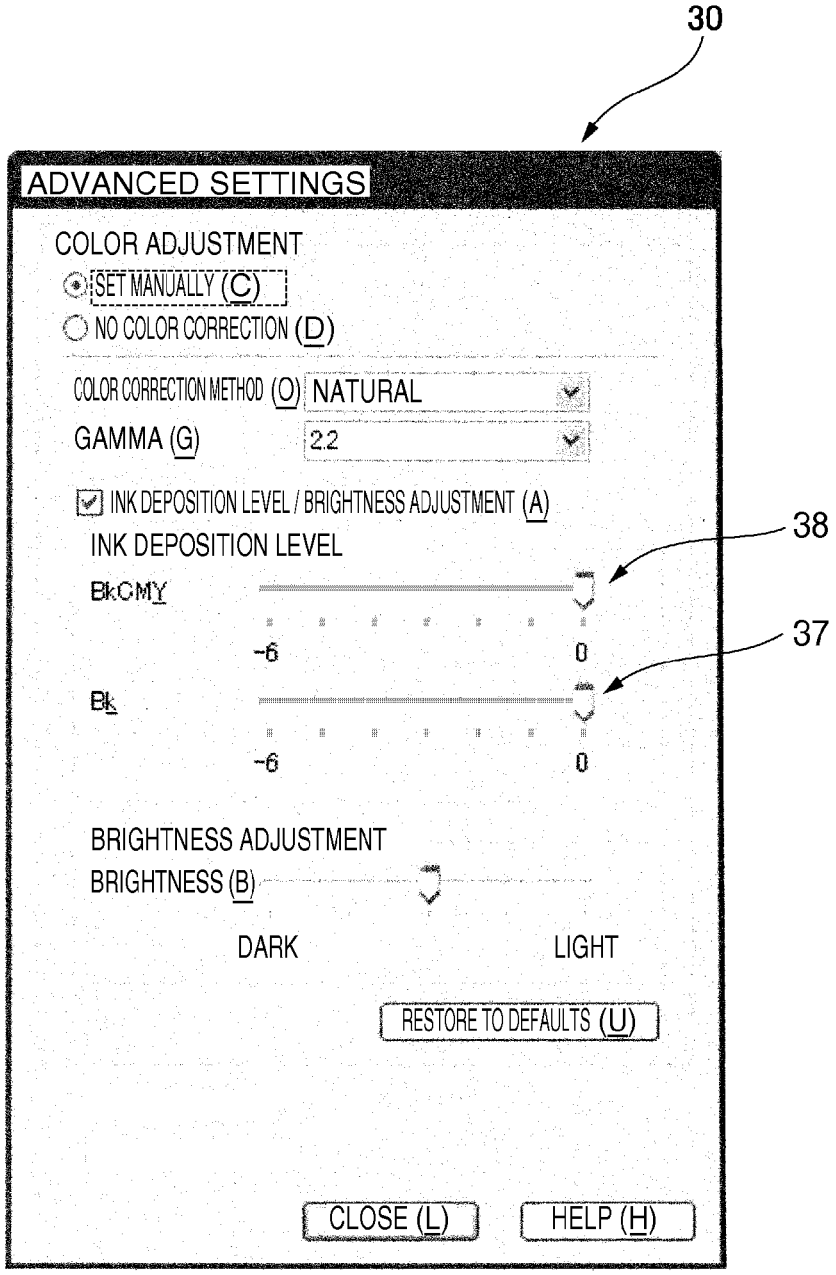
FIG. 6 describes a dialog box displayed by a printer driver.

FIG. 6 describes the dialog box that the correction ratio input unit 25 displays on the display 4. In the middle of the dialog box 30 is a third slider 37 for accepting input of the specific correction ratio. Above the third slider 37, the dialog box 30 also has a fourth slider 38 for accepting input of the total correction ratio.

The third slider 37 is normally set to 0 on the scale. The specific correction ratio for correcting the rated discharge volume of black ink Bk corresponds to markers −1 to −6 on the scale of the third slider 37. In this embodiment, the specific correction ratios of 95%, 90%, 85%, 80%, 75%, 70% correspond sequentially to markers −1 to −6. When the third slider 37 is not adjusted and remains set to 0 on the scale, the specific correction ratio is 100%.

When the third slider 37 is operated and set to the desired scale marker −1 to −6 (setting), the discharge volume of black ink Bk is reduced from the rated discharge volume by the actual discharge volume setting unit 34. Because black ink Bk is inferior to the other inks in water resistance and scratch-fastness, reducing the discharge volume of black ink Bk results in a relative improvement in the water resistance and scratch-fastness of the printed image. The third slider 37 is therefore operated when improving the water resistance and scratch-fastness of the printed image is desirable.

The fourth slider 38 is also normally set to 0 on the scale. The total correction ratio for correcting the rated discharge volume of each ink C, M, Y, Bk corresponds to markers −1 to −6 on the scale of the fourth slider 38. In this embodiment, the total correction ratios of 95%, 90%, 85%, 80%, 75%, 70% correspond sequentially to markers −1 to −6. When the fourth slider 38 is not adjusted and remains set to 0 on the scale, the total correction ratio is 100%.

When the fourth slider 38 is operated and set to the desired scale marker −1 to −6 (setting), the discharge volume of each ink C, M, Y, Bk is reduced from the rated discharge volume by the actual discharge volume setting unit 34. Because the total discharge volume of ink thus decreases and the print density decreases, the fourth slider 38 can be operated in order to reduce bleeding in the printed image.

To suppress bleeding in the printed image and improve the water resistance and scratch-fastness of the printed image, both the third slider 37 and fourth slider 38 are operated.

The actual discharge volume setting unit 34 corrects the rated discharge volume of each ink C, M, Y, Bk based on the specific correction ratio corresponding to the setting of the third slider 37, and the total correction ratio corresponding to the setting of the fourth slider 38, and sets the actual discharge volume for discharging the inks C, M, Y, Bk when printing. When the third slider 37 and fourth slider 38 are not moved from the 0 position, the actual discharge volume setting unit 34 sets the rated discharge volume of each ink C, M, Y, Bk as the actual discharge volume for each ink.

The actual discharge volume setting unit 34 has a first actual discharge volume setting unit 35 that sets the actual discharge volume of each ink C, M, Y, Bk when only the third slider 37 is operated, and a second actual discharge volume setting unit 36 that sets the actual discharge volume of each ink C, M, Y, Bk when the fourth slider 38 is operated. When the fourth slider 38 is moved includes when only the fourth slider 38 is adjusted and when both the third slider 37 and fourth slider 38 are adjusted.

When only the third slider 37 is adjusted, the first actual discharge volume setting unit 35 reduces the rated discharge volume of black ink Bk by the specific correction ratio corresponding to the setting of the third slider 37, and sets the actual discharge volume of black ink Bk to this reduced level. The actual discharge volume Bkvq of black ink Bk is obtained by equation (1) below where Bkrq is the rated discharge volume, Bkfr (%) is the specific correction ratio, and Bkvq is the actual discharge volume of black ink Bk.

$$Bkvq=Bkrq\times Bkfr \tag{1}$$

When only the third slider 37 is operated, the first actual discharge volume setting unit 35 increases the rated discharge volume of the chromatic inks C, M, Y by the difference between the rated discharge volume of black ink Bk and the actual discharge volume of black ink Bk to obtain the actual discharge volume of each chromatic ink C, M, Y. The difference between the rated discharge volume of black ink Bk and the actual discharge volume of black ink Bk is the decrease in the black ink Bk discharge volume determined by reducing the rated discharge volume based on the specific correction ratio.

In this embodiment, the difference between the rated discharge volume of black ink Bk and the actual discharge volume of black ink Bk is divided evenly by 3, the number of chromatic colors of ink, and the calculated result is added to the rated discharge volume of each chromatic ink C, M, Y to get the actual discharge volume of each. Therefore, the volume obtained by increasing the rated discharge volume of each chromatic ink C, M, Y an equal amount is the actual discharge volume of each chromatic ink C, M, Y. The difference between the rated discharge volume of black ink Bk and the actual discharge volume of black ink Bk is therefore equal to the total of the differences between the actual discharge volume and the rated discharge volume of each chromatic ink C, M, Y. As a result, the total corrected discharge volume of ink when only the third slider 37 is operated does not change and is kept the same as the discharge volume of all inks when each ink C, M, Y, and Bk is discharged at the rated discharge volume.

If the rated discharge volume of each chromatic ink C, M, Y is CMYrq, the rated discharge volume of black ink Bk is Bkrq, the actual discharge volume of black ink Bk is Bkvq, and the actual discharge volume of the chromatic inks C, M, Y is CMYvq, the actual discharge volume CMYvq of the chromatic inks C, M, Y is as shown in equation (2) below. Note that Bkvq (the actual discharge volume of black ink Bk) is obtained from equation (1) above.

$$CMYvq=CMYrq+(Bkrq-Bkvq)/3 \tag{2}$$

When the fourth slider 38 is operated (an event in which only the fourth slider 38 is operated, or both the third slider 37 and fourth slider 38 are operated), the second actual discharge volume setting unit 36 determines the actual discharge volume of black ink Bk by reducing the rated discharge volume of black ink Bk by the specific correction ratio corresponding to the setting of the third slider 37 and the total correction ratio corresponding to the setting of the fourth slider 38.

If the rated discharge volume of black ink Bk is Bkrq, the total correction ratio is Allfr (%), the specific correction ratio is Bkfr (%), and the actual discharge volume of black ink Bk is Bkvq, the actual discharge volume Bkvq of black ink Bk is determined by equation (3) below.

$$Bkvq=Bkrq\times Allfr\times Bkfr \tag{3}$$

When the fourth slider 38 is operated (an event in which only the fourth slider 38 is operated, or both the third slider 37 and fourth slider 38 are operated), the second actual discharge volume setting unit 36 calculates the corrected discharge volume of each ink by reducing the rated discharge volume of each chromatic ink C, M, Y based on the total correction ratio, and increases each calculated corrected discharge volume based on the difference between the rated discharge volume of black ink Bk and the specific corrected discharge volume obtained by reducing the rated discharge volume of black ink Bk based on the total correction ratio to obtain the actual discharge volume of each chromatic ink C, M, Y. The difference between the rated discharge volume of black ink Bk and the specific corrected discharge volume of black ink Bk is the amount that the rated discharge volume of black ink Bk was reduced based on the total correction ratio.

In this embodiment, the difference between the rated discharge volume of black ink Bk and the specific corrected discharge volume of black ink Bk is divided evenly by 3, the number of chromatic inks, and this calculated amount is added to the corrected discharge volume of each chromatic ink C, M, Y to obtain the actual discharge volume of each ink. The actual discharge volume of each chromatic ink C, M, Y is the corrected discharge volume of each chromatic ink C, M, Y increased this equal amount. If the rated discharge volume of each chromatic ink C, M, Y is CMYrq, the rated discharge volume of black ink Bk is Bkrq, the total correction ratio is Allfr (%), the specific correction ratio is Bkfr (%), the specific corrected discharge volume of black ink Bk is Bkaq, the corrected discharge volume of each chromatic ink C, M, Y is CMYaq, and the actual discharge volume of each chromatic ink C, M, Y is CMYvq, the specific corrected discharge volume Bkaq of black ink Bk is obtained by the following equation (4), and the corrected discharge volume CMYaq of each chromatic ink C, M, Y is obtained by equation (5). The actual discharge volume CMYvq of each chromatic ink C, M, Y is therefore obtained by equation (6).

$$Bkaq=Bkrq\times Allfr \quad (4)$$

$$CMYaq=CMYrq\times Allfr \quad (5)$$

$$CMYvq=CMYaq+(Bkrq-Bkaq)/3 \quad (6)$$

The discharge volume setting operation of the actual discharge volume setting unit 34 is described next with reference to FIG. 7. FIG. 7 describes the discharge volume setting operation whereby the actual discharge volume setting unit 34 sets the actual discharge volume of each ink C, M, Y, Bk. When the color conversion module 23 converts the RGB gray-scale data of a specific pixel in the image data to ink volume data, the rated discharge volume of each ink C, M, Y, Bk is 25, and the total ink discharge volume is 100. The discharge volume can be expressed by weight or other measure, but for simplicity here is described without using a unit of measurement.

In the example shown in FIG. 7A, the third slider 37 and fourth slider 38 have not been changed from the normal position at 0. In this event, the actual discharge volume of each ink C, M, Y, Bk is the rated discharge volume of each ink C, M, Y, Bk.

In the example shown in FIG. 7B, only the third slider 37, which is used to reduce the discharge volume of black ink Bk, is adjusted and is set to −1 on the scale. In this event, the specific correction ratio corresponding to the setting of the third slider 37 is 95%. Therefore, the first actual discharge volume setting unit 35 substitutes the rated discharge volume (Bkrq=25) and the specific correction ratio (Bkfr=95%) of black ink Bk into equation (1), and calculates the actual discharge volume (Bkvq=23.8) of black ink Bk. The first actual discharge volume setting unit 35 also inserts the rated discharge volume (CMYrq=25) of each chromatic ink C, M, Y, and the rated discharge volume (Bkrq=25) and the actual discharge volume (Bkvq=23.8) for black ink Bk, into equation (2) above, and calculates the actual discharge volume (CMYvq=25.4) of each chromatic ink C, M, Y as a result.

In the example shown in FIG. 7C, both the fourth slider 38 that reduces the discharge volume of each ink C, M, Y, Bk, and the third slider 37 that reduces the discharge volume of black ink Bk, are operated and set to −1 on their respective scales. In this event, the specific correction ratio corresponding to the setting of the third slider 37 is 95%, and the total correction ratio corresponding to the setting of the fourth slider 38 is 95%.

The second actual discharge volume setting unit 36 therefore inserts the rated discharge volume of black ink Bk (Bkrq=25), the total correction ratio (Allfr=95%), and the specific correction ratio (Bkfr=95%) into equation (3), and calculates the actual discharge volume (Bkvq=22.6) for black ink Bk as a result.

The second actual discharge volume setting unit 36 also inserts the rated discharge volume of black ink Bk (Bkrq=25) and the total correction ratio (Allfr=95%) into equation (4), and calculates the specific corrected discharge volume (Bkaq=23.75) of black ink Bk as a result.

The second actual discharge volume setting unit 36 also inserts the rated discharge volume (CMYrq=25) of each chromatic ink C, M, Y and the total correction ratio (Allfr=95%) into equation (5), and calculates the corrected discharge volume (CMYaq=23.8) of each chromatic ink C, M, Y as a result.

Yet further, the second actual discharge volume setting unit 36 inserts the corrected discharge volume of each chromatic ink C, M, Y (CMYaq=23.8) obtained from equation (5), the rated discharge volume of black ink Bk (Bkrq=25), and the specific corrected discharge volume of black ink Bk (Bkaq=23.8) into equation (6), and calculates the actual discharge volume (CMYvq=24.2) of each chromatic ink C, M, Y as a result.

When both the third slider 37 and fourth slider 38 are adjusted, the total discharge volume of ink after correction is less than the total discharge volume of ink before correction.

When only the fourth slider 38, which reduces discharge of each ink C, M, Y, Bk, is operated, the specific correction ratio is 100%, and the actual discharge volume of each ink C, M, Y, Bk is set as shown in FIG. 7C. The total discharge volume of ink after correction is also less than the total discharge volume of ink before correction when only the fourth slider 38 is operated.

This embodiment divides the difference between the rated discharge volume of black ink Bk and the specific corrected discharge volume of black ink Bk equally by 3, the number of chromatic inks, and adds this equal amount to the corrected discharge volume of each chromatic ink C, M, Y to calculate the actual discharge volume of each chromatic ink C, M, Y. However, instead of dividing the difference to the specific corrected discharge volume equally by the number of chromatic inks (C, M, Y), that is, 3, the difference could be distributed according to the CMY ratio before correction and added to the corrected discharge volume of each chromatic ink C, M, Y to get the actual discharge volumes.

The command conversion module 28 then converts the ink volume data (actual discharge volume) of each ink C, M, Y, Bk for printing each pixel to print commands. Note that this embodiment uses three sizes of ink droplets (large, medium, small) as the ink droplets that are discharged to the recording paper from the inkjet head when depositing ink onto the recording paper, and the volume of each ink C, M, Y, Bk discharged to the recording paper is adjusted by a print command that controls the ratio of ink droplets of each size (large, medium, small). The discharge volume in this embodiment is expressed by capacity (nl) or weight (ng), for example, and by the ratio of three sizes of ink droplets (large, medium, small).

The print command output unit 29 outputs the print commands produced by the command conversion module 28 to the inkjet printer 3. The inkjet printer 3 then controls operation according to the print commands, and prints an image on the recording paper.

Image Data Printing Process

Figure 8:
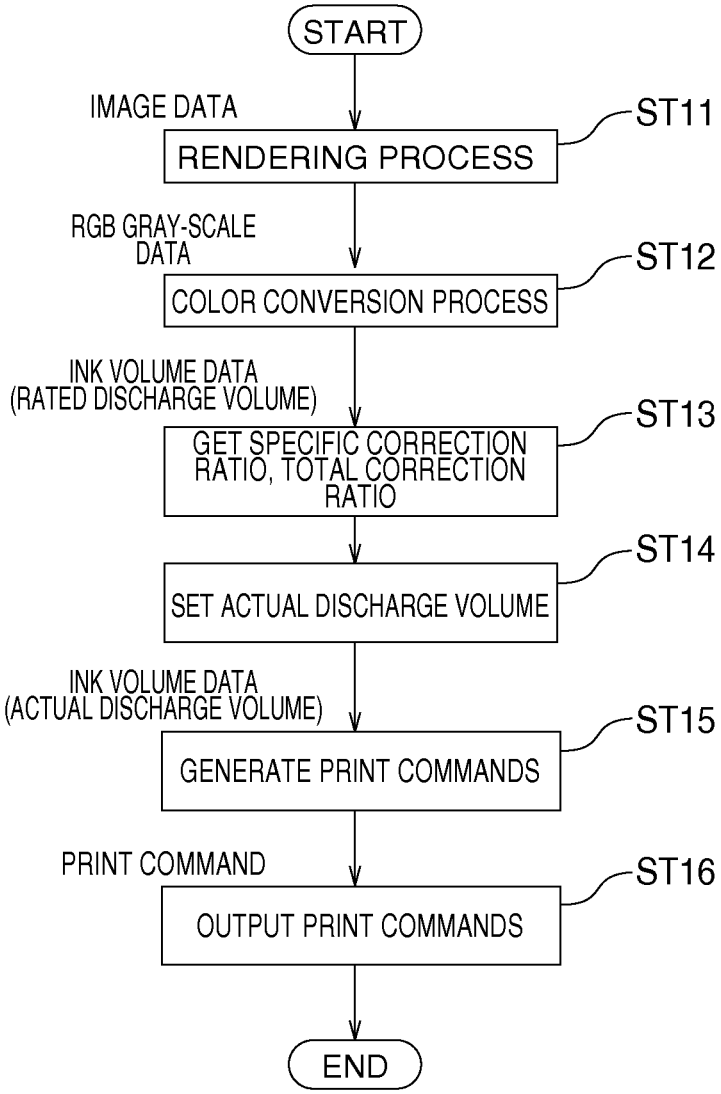
FIG. 8 is a flow chart of the printing process of the printing system.

FIG. 8 is a flow chart of the image data printing process in at least one embodiment of the present invention.

When the printer driver execution unit 12 receives image data from the application program execution unit 11, the top driver layer 21 applies a rendering process to the image data and converts each pixel to RGB gray-scale data (step ST11). When the RGB gray-scale data is output from the top driver layer 21, the color process module executes a color conversion process that converts the RGB gray-scale data to ink volume data (rated discharge volume) for each ink C, M, Y, Bk by means of the color process LUTs 24 (step ST12).

The actual discharge volume setting unit 34 then checks the setting of the third slider 37 and the setting of the fourth slider 38, corrects the rated discharge volume of each ink C, M, Y, Bk based on the specific correction ratio and total correction ratio corresponding to the slider settings, and determines the actual discharge volume for discharging each ink C, M, Y, Bk when printing (steps ST14, ST14).

Once the actual discharge volume setting unit 34 sets the ink volume data (actual discharge volume) for each ink C, M, Y, Bk, the command conversion module 28 generates the print commands based on the ink volume data (step ST15). The print command output unit 29 then outputs the generated print commands to the inkjet printer 3 (step ST16). The inkjet printer 3 then controls operation according to the print commands and prints an image.

This embodiment of the invention enables reducing the discharge volume of black ink Bk and improving the water resistance and scratch-fastness of the printed image by operating a third slider 37. Therefore, when the image data is a 2D code symbol, and the printout produced based on the image data is used in an application where the printout may be exposed to water drops, the third slider 37 can be used to reduce the volume of black ink Bk that is discharged and improve the water resistance of the 2D code symbol. When the printout produced based on the image data is used in an application where the printout is easily rubbed, the third slider 37 can be used to reduce the volume of black ink Bk that is discharged and improve the scratch-fastness of the 2D code symbol.

The fourth slider 38 can also be used in this embodiment to reduce the volume of ink C, M, Y, Bk discharged, and suppress bleeding in the printed image. For example, if the printed image is a 2D code symbol and there is bleeding in the printout, the reading accuracy of a code reader used to read the 2D code symbol drops.

Therefore, when printing the image data on recording paper where bleeding occurs easily, the fourth slider 38 can be used to reduce the discharge volume of each ink C, M, Y, Bk and reduce bleeding. Note that because operating the fourth slider 38 reduces the discharge of each ink C, M, Y, Bk onto the recording paper, consumption of each ink C, M, Y, Bk can also be reduced by operating the fourth slider 38.

When the discharge volume of black ink Bk is reduced by moving the third slider 37 or fourth slider 38, dots may be missing in black lines formed on the recording paper. Dots may also be missing in contour lines of graphics formed on the recording paper, and identifying the contour of a graphic element may be difficult. When the image data is for printing a 2D code symbol, for example, white space in black lines in the printed image forming the 2D code symbol can occur, the contour of the black areas may be indefinite, and the 2D code symbol may not be read accurately.

To solve this problem, this embodiment increases the actual discharge volume of each chromatic ink C, M, Y to greater than the rated discharge volume of each chromatic ink C, M, Y when a specific correction ratio for reducing only the discharge volume of black ink Bk is received.

In addition, when a total correction ratio that reduces the total discharge volume of ink is received, the actual discharge volume of each chromatic ink C, M, Y is increased to greater than the corrected discharge volume, which lowers the rated discharge volume of each chromatic ink C, M, Y based on the total correction ratio. In other words, when the discharge volume of black ink Bk is reduced, this embodiment compensates for part or all of the reduction in black ink Bk by increasing the discharge volume of each chromatic ink C, M, Y. As a result, the appearance of missing dots in the printout can be suppressed because missing dots that occur in the printout due to a decrease in the volume of black ink Bk discharged can be covered by increasing the amount of each chromatic ink C, M, Y deposited on the recording paper. Therefore, when the image data is for printing a 2D code symbol on the recording paper, a drop in accuracy reading a 2D code symbol that is printed by reducing the amount of black ink Bk can be suppressed or prevented.

The discharge volume of black ink Bk is adjusted in this second embodiment by operating the third slider 37, but a configuration in which operating the third slider 37 inputs a specific correction ratio for reducing the discharge volume of one of the chromatic inks C, M, Y is also conceivable.

Various embodiments of the invention being thus described, it will be apparent that such embodiments may be varied in many ways. Such variations are not to be regarded as a departure from the spirit and scope of the instant disclosure, and are intended to be included within the scope of the following claims.

What is claimed is:

1. A print control device that controls a recording device that discharges a plurality of inks and records print data including a symbol code on a recording medium, the print control device comprising:

a total correction ratio input unit that receives input of a total correction ratio that uniformly reduces a rated discharge volume of each ink to a corrected discharge volume of each ink;

a specific correction ratio input unit that receives input of a specific correction ratio that reduces the rated discharge volume of one specific ink of the plurality of inks; and a discharge volume correction unit that reduces the rated discharge volume of each ink based on the total correction ratio and the specific correction ratio;

wherein the discharge volume correction unit reduces the rated discharge volume of the specific ink to the actual discharge volume of the specific ink based on the product of the total correction ratio and the specific correction ratio;

wherein the discharge volume correction unit reduces the rated discharge volume of each of the other inks to the corrected discharge volume of each of the other inks based on the total correction ratio, and increases the corrected discharge volume of each of the other inks to the actual discharge volume of each of the other inks based on a difference between the rated discharge volume of the specific ink and the actual discharge volume of the specific ink; and wherein the specific ink is discharged in recording the symbol code on the recording medium and contains more color material than the other inks.

2. The print control device described in claim 1, wherein:

the total correction ratio input unit displays a total correction ratio input screen to receive input of the total correction ratio; and the specific correction ratio input unit displays a specific correction ratio input screen to receive input of the specific correction ratio.

3. The print control device described in claim 1, wherein:

the specific ink has inferior water resistance or scratch-fastness than the other inks.

4. The print control device described in claim 1, wherein:

the plural inks are cyan ink, magenta ink, yellow ink, and black ink; and the specific ink is black ink.

5. A printing system comprising:

the print control device described in claim 1; and a printing device that is connected to the print control device and records on a recording medium by discharging the plurality of inks.

6. The print control device described in claim 1, wherein:

the difference between the rated discharge volume of the specific ink and the actual discharge volume of the specific ink is equal to the total difference between the actual discharge volume and the rated discharge volume of each of the other inks.

7. The print control device described in claim 1, wherein:

the discharge volume correction unit increases the corrected discharge volume of each other ink based on the difference between the rated discharge volume of the specific ink and the specific corrected discharge volume that reduces the rated discharge volume of the specific ink based on the total correction ratio.

8. The print control device described in claim 7, wherein:

the difference between the rated discharge volume of the specific ink and the specific corrected discharge volume is equal to the total of the differences between the actual discharge volume and the corrected discharge volume of each of the other inks.

9. The print control device described in claim 1, wherein:

the correction ratio receiving unit displays a correction ratio input screen for receiving the total correction ratio and the specific correction ratio.

* * * * *